United States Patent [19]

Ohtomo et al.

[11] Patent Number: 4,992,026

[45] Date of Patent: Feb. 12, 1991

[54] GAS TURBINE BLADE

[75] Inventors: Fumio Ohtomo; Yasuo Okamoto, both of Yokohama; Shoko Ito, Tokyo; Yoshitaka Fukuyama, Yokohama; Hideo Iwasaki, Kawasaki; Takeshi Watanabe, Ooiso, all of Japan

[73] Assignee: Kabushiki Kaisha Toshiba, Kawasaki, Japan

[21] Appl. No.: 370,080

[22] Filed: Jun. 22, 1989

Related U.S. Application Data

[63] Continuation-in-part of Ser. No. 31,268, Mar. 30, 1987, abandoned.

[30] Foreign Application Priority Data

Mar. 31, 1986 [JP] Japan ..... 61-72971

[51] Int. Cl.[5] ..... B63H 1/14

[52] U.S. Cl. ..... 416/97 R; 416/96 A; 415/115

[58] Field of Search ..... 416/96 R, 96 A, 97 R, 416/97 A; 415/115

[56] References Cited

U.S. PATENT DOCUMENTS

| | | | |
|---|---|---|---|
| 3,628,885 | 12/1971 | Sidenstick et al. | 416/97 R |
| 4,073,599 | 2/1978 | Allen et al. | 416/97 R |
| 4,162,136 | 7/1979 | Parkes | 416/96 A |
| 4,650,399 | 3/1987 | Craig et al. | 416/96 A |

FOREIGN PATENT DOCUMENTS

| | | | |
|---|---|---|---|
| 1087527 | 10/1980 | Canada | 416/92 |
| 1204021 | 10/1965 | Fed. Rep. of Germany . | |
| 2144735 | 2/1973 | France . | |
| 2147971 | 3/1973 | France . | |
| 2385900 | 4/1977 | France . | |
| 47-40209 | 10/1972 | Japan . | |
| 55-107005 | 8/1980 | Japan . | |
| 58-117303 | 7/1983 | Japan . | |
| 0202303 | 11/1983 | Japan | 416/97 R |
| 0202304 | 11/1983 | Japan | 416/97 R |
| 0018202 | 1/1984 | Japan | 416/97 R |
| 62-228603 | 10/1987 | Japan . | |
| 1188401 | 4/1970 | United Kingdom . | |

*Primary Examiner*—Edward K. Look
*Assistant Examiner*—Therese M. Newholm
*Attorney, Agent, or Firm*—Oblon, Spivak, McClelland, Maier & Neustadt

[57] ABSTRACT

A blade of a gas turbine includes a main body having a dovetail portion and a blade portion extending from the dovetail portion. A cooling air passage for flowing a cooling air is formed in the main body to cool the blade portion. The passage includes a cooling air inlet port open to the dovetail portion and an outlet port open to an extended tip of the blade portion. A first passage portion extends from the inlet port to the portion close to the extended tip along a leading edge of the blade portion. A final passage portion extends from the dovetail portion to the outlet port. The flow sectional area of the final passage portion is gradually decreased from the dovetail portion toward the outlet port. The final passage portion communicates with a number of film cooling holes which are open to the suction side surface of the blade portion.

16 Claims, 5 Drawing Sheets

GAS TURBINE BLADE

This application is a continuation-in-part of application Ser. No. 031,268, filed on March 30, 1987, now abandoned.

FIELD OF THE INVENTION

The present invention relates to a gas turbine blade and, more particularly, to a blade which can be applied to a gas turbine using coal gas fuel.

BACKGROUND OF THE INVENTION

As is known, relative to a reciprocal engine, a gas turbine is compact and lightweight and can provide high power.

A gas turbine, e.g., a balanced pressure combustion type gas turbine, normally comprises a cylindrical casing and a rotating shaft which is rotatably arranged in the casing. A compressor and a power turbine are formed between two ends of the rotating shaft and the casing. A plurality of combustors are arranged between the compressor and the power turbine, and pressure in the combustors is increased by high-pressure air compressed by the compressor. In this state, fuel is injected to the combustor and is combusted. A high-pressure, high-temperature gas, generated by combustion, is guided to the power turbine and is expanded in volume, thereby obtaining power for rotating the rotating shaft.

The compressor has an axial flow arrangement, where rotor blades fixed to the rotating shaft and guide vanes fixed to the casing are alternately arranged along the axial direction of the rotating shaft. In the power turbine, rotor blades fixed to the rotating shaft and nozzle vanes fixed to the casing are alternately arranged along the axial direction of the rotating shaft.

In the gas turbine with the above arrangement, as a most effective means for improving a gas turbine efficiency, a gas temperature at the entrance of the power turbine is increased. However, the maximum permissible temperature of the metal material constituting the power turbine is normally about 850° C. Therefore, in order to increase the gas temperature beyond the permissible temperature, members constituting the power turbine, in particular, blades, must be cooled with high efficiency.

In a conventional gas turbine using clean fuel such as petroleum, LNG, or the like, the blade is cooled by a cooling method combining a convection cooling method, wherein the blade is cooled from inside, and a film cooling method, wherein cooling air is ejected from a plurality of portions of the blade to cool the blade. Cooling air ejection holes are formed at high density on a portion, (e.g., a leading edge portion) of the blade, which becomes very high in temperature, thus providing a so-called shower head structure.

In recent years, a high-efficiency coal gasification combined power generation system using dirty fuel such as coal gasification fuel has been developed. In this system, a gas temperature at the turbine entrance must be increased beyond 1,300° C. in order to improve a plant efficiency. However, when the turbine is operated under the high-temperature condition, coal ash may become attached to the blade surface, or the blade surface may be corroded by the ash. For this reason, cooling air ejection holes which are open to the blade surface may often clog. Therefore, in this system, the normal film cooling method cannot be effectively utilized exclusively.

Accordingly, it is difficult to realize a high-efficiency gas turbine using dirty fuel, unless the blade is satisfactorily cooled not only by the film cooling method but also by other means.

OBJECT OF THE INVENTION

The present invention has been made in consideration of the above situation, and has as its object to provide a gas turbine blade with a good cooling performance, which can be applied to a high-efficiency gas turbine using dirty fuel such as coal gasification fuel.

SUMMARY OF THE INVENTION

In order to achieve the above object, the blade of the present invention comprises: a main body including a dovetail portion, and a blade portion extending from the dovetail portion, the blade portion having an extended tip, leading and trailing edges which extend substantially along the extending direction of the blade portion, and a suction side surface and a pressure side surface which are located between the leading and trailing edges and face each other; and cooling means for introducing cooling air inside the main body to cool the main body, the cooling means including a cooling air passage formed in the main body, the cooling air passage having a cooling air inlet port open to the dovetail portion, an outlet port open to the extended tip of the blade portion, a first passage portion extending from the inlet port toward the extended end of the blade portion along the leading edge, a final passage portion extending from the dovetail portion to the outlet port, and a plurality of film cooling holes which are open to the suction side surface of the blade portion and communicate with the final passage portion, the cooling means having flow sectional area decreasing means fitted to the outlet port, for gradually decreasing a flow sectional area of the final passage portion from the dovetail portion toward the outlet port so that the speed of the cooling air flowing through the final passage portion does not fall despite the fact that air flows out through the film cooling holes.

BRIEF DESCRIPTION OF THE DRAWINGS

FIGS. 1 and 2 show a gas turbine blade according to a first embodiment of the present invention, in which FIG. 1 is a longitudinal sectional view of the blade, and FIG. 2 is a sectional view taken along line II—II in FIG. 1;

DETAILED DESCRIPTION OF THE PREFERRED EMBODIMENTS

Embodiments of the present invention will now be described in detail with reference to the accompanying drawings.

Figure 1:
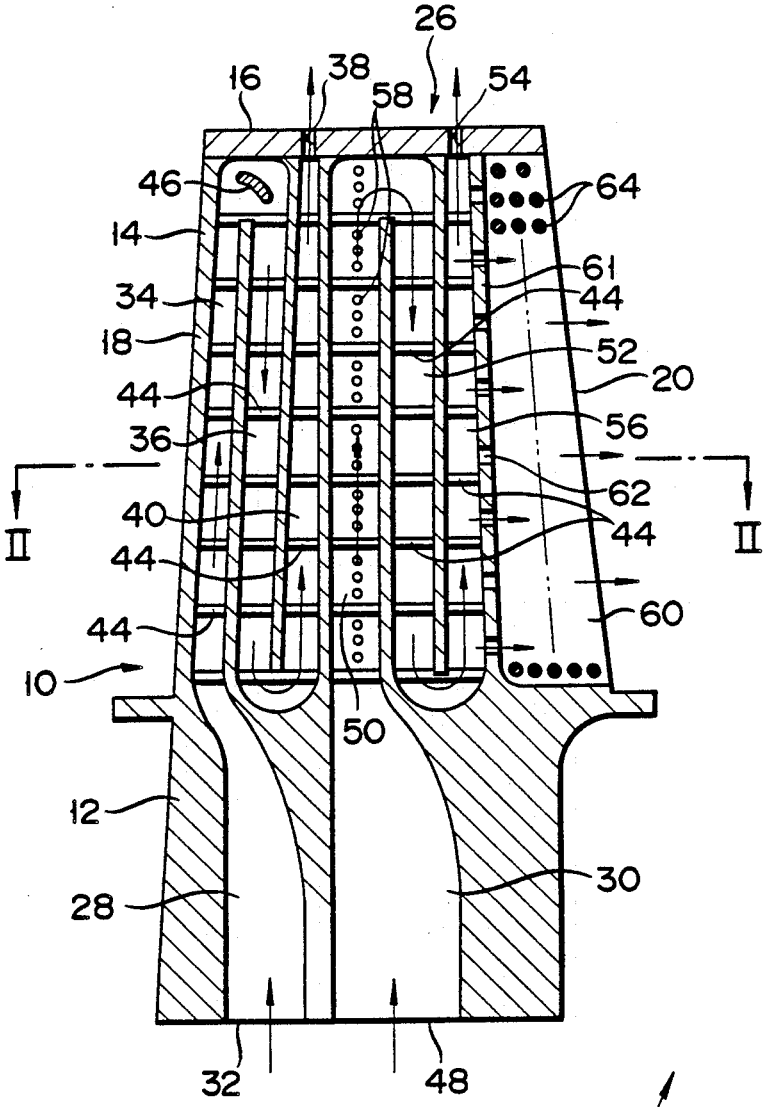
Figure 2:
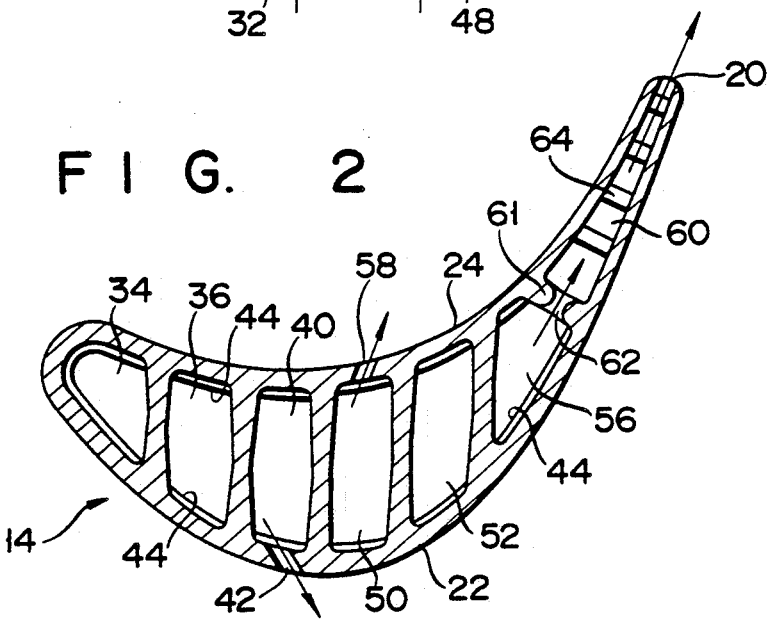

As shown in FIGS. 1 and 2, a gas turbine blade comprises main body 10 which has a dovetail portion 12 fixed to a rotating shaft (not shown) of a gas turbine, and a blade portion 14 extending from the dovetail portion 12. The main body 10, as a whole, is threedimensionally extended like the known one. More specifically, the blade portion 14 has an extended tip 16, a leading edge 18, and a trailing edge 20 extending from the dovetail portion 12 to the extended end 16 along the extending direction of the blade portion 14. The blade portion 14 has a suction side surface 22 and a pressure side surface 24 which are located between the leading and trailing edges 18 and 20, respectively.

First and second cooling air passages 28 and 30 are formed in the main body 10 as cooling means 26 for flowing cooling air to cool the main body 10.

The first cooling air passage 28 has a cooling air inlet port 32 which is open to the dovetail portion 12 and is connected to a cooling air supply source (not shown), and a first passage portion 34 which extends from the cooling air inlet port 32 close to the extended tip 16 along the leading edge 18 of the blade portion 14. The first cooling air passage 28 has a communicating passage portion 36 which returns from the upper end of the first passage portion 34 toward the trailing edge 20 and extends close to the dovetail portion 12, an outlet port 38 which is open to the extended tip 16 of the blade portion 14, and a final passage portion 40 which returns from the lower end of the communicating passage portion 36 toward the trailing edge 20 and extends to the outlet port 38. The final passage portion 40 is formed so that its sectional area is gradually decreased toward the downstream side,—i.e., from the dovetail portion 12 toward the outlet port 38. The final passage portion 40 is located at substantially the middle portion between the leading and trailing edges 18 and 20. Further, the first passage portion 40 communicates with a plurality of film cooling holes 42 open to the suction side surface 22. The film cooling holes 42 are formed at the middle portion between the leading and trailing edges 18 and 20, and they are spaced from each other along the extending direction of the final passage portion 40. A plurality of turbulence promoters 44 project from the inner surfaces of the passage portions 34, 36, and 40 and extend in a direction perpendicular to the extending direction of the respective passages so as to promote heat conduction. A corner vane 46 is arranged in a returning portion between the first passage portion 34 and the communicating passage portion 36, for decreasing pressure loss of air flowing therethrough.

The second cooling air passage 30 has cooling air inlet port 48 which is open to the dovetail portion 12 and is connected to the cooling air supply source (not shown), and a first passage portion 50 which extends from the cooling air inlet port 48 close to the extended tip 16 along the final passage portion 40 of the first cooling air passage 28. The second cooling air passage 30 has a communicating passage portion 52 which returns from the upper end of the first passage portion 50 toward the trailing edge 20 and extends close to the dovetail portion 12, an outlet port 54 which is open to the extended tip 16 of the blade portion 14, and final passage portion 56 which returns from the lower end of the communicating passage portion 52 toward the trailing edge 20 and extends to the outlet port 54. The final passage portion 56 is formed so that its flow sectional area is gradually decreased toward the downstream side,—i.e., from the dovetail portion 12 toward the outlet port 54. The first passage portion 50 communicates with a plurality of film cooling holes 58 which are open to the pressure side surface 24, and the film cooling holes 58 are aligned to be spaced from each other along the extending direction of the first passage portion 50. A slit 60 extending along the extending direction of blade portion 14 is formed in the trailing edge portion 20 of the blade portion 14. The final passage portion 56 communicates with the slit 60 through a plurality of air holes 62 which are formed in a partition wall 61. The partition wall 61 is located between the final passage portion 56 and the slit 60. The air holes 62 are aligned, to be spaced from each other, along the extending direction of the blade portion 14. A plurality of pins 64 are arranged in the slit 60, and the pins 64 extend in a direction perpendicular to the side surfaces 22 and 24 of the blade portion 14. A plurality of turbulence promoters 44 project from the inner surfaces of passage portions 50, 52, and 56 and extend in a direction perpendicular to the extending direction of the respective passages so as to promote heat conduction.

Figure 3:
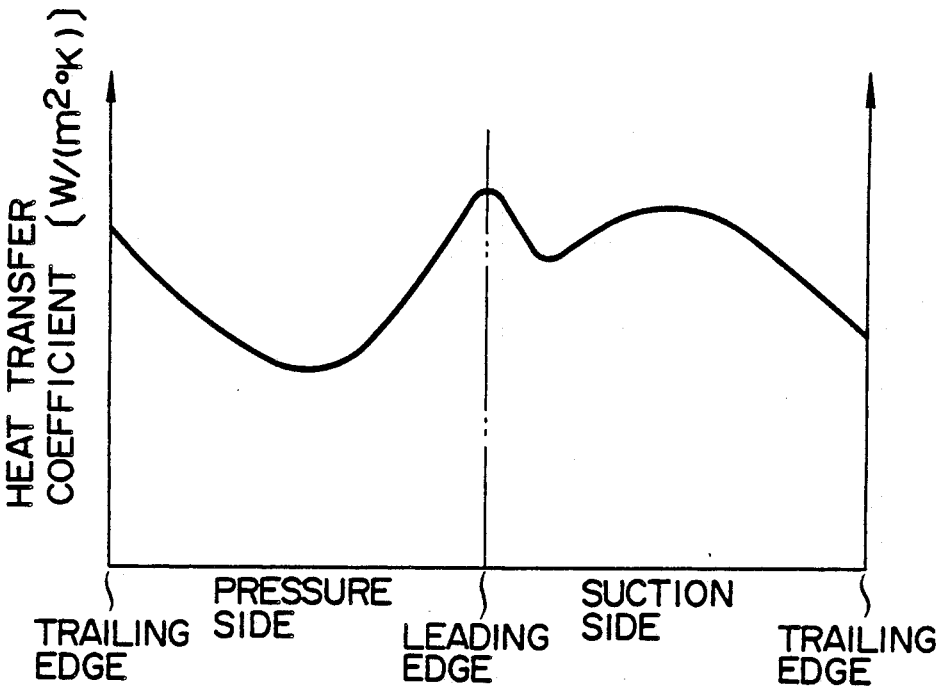
FIG. 3 is a view showing a distribution of the heat transfer coefficient of the blade surface.

When the blade having the above arrangement is applied to a gas turbine, generally, the distribution of the heat transfer coefficient ($W/m^2OK$) on the surface of the blade is as shown in FIG. 3. As can be seen from FIG. 3, the leading edge portion, the intermediate portion of the suction side surface 22, and the trailing edge portion have a high heat transfer coefficient.

According to the blade having above-described cooling means 26, low-temperature air introduced from the cooling air inlet port 32 into the first cooling air passage 28 flows through the first passage portion 34, and in this case, cools the leading edge 18 of the blade portion 14. Subsequently, the air flows through the communicating passage portion 36 to cool the surrounding portion, and then it enters the final passage portion 40. Part of the cooling air flowing through the final passage portion 40 is ejected from the film cooling holes 42 and flows toward the trailing edge 20 along the suction side surface 22, thereby cooling that portion of the suction side surface 22 which extends between the intermediate portion and the trailing edge 20. The remaining air is discharged outside from the outlet port 38. The final passage portion 40 is formed so that its flow sectional area is gradually decreased from the upstream side toward the downstream side. Thus, the velocity of the air flowing through the final passage portion 40 is not reduced despite the fact that part of the air is ejected for film cooling. For this reason, a sufficient convection cooling effect can be obtained by the air flowing through the final passage portion 40. Further, although the pressure outside the intermediate portion of the suction side surface 22 is high, air flowing through final passage portion 40 can be satisfactorily discharged from the film cooling holes 42, and it can be smoothly delivered from the outlet port 38.

Low-temperature air introduced from the cooling air inlet port 48 into the second cooling air passage 30 flows through the first passage portion 50 to cool the intermediate portion of the blade portion 14, and it is partially ejected outside from the film cooling holes 58. The ejected air flows toward the trailing edge 20 along the pressure side surface 24 of the blade portion 14, and it cools the pressure side surface 24, in particular, a portion of the pressure side surface on the side of the trailing edge 20. The remaining air flows through the communicating passage portion 52 to cool the surrounding portion, and then enters the final passage portion 56. The velocity of air flowing through the final passage portion 56 is not reduced due to the shape of the final passage portion 56, and the air therefor provides a stable convection cooling. Thus, the air satisfactorily cools the surrounding portion. At the same time, part of the air is discharged from the air holes 62 into the slit 60 and collides against the pins 64, thereby cooling the pins 64 and the trailing edge 20. The remaining air is delivered outside from the outlet port 54.

With the blade having the above construction, low-temperature air introduced into the first cooling air passage 28 flows along the leading edge portion 18 (which has the severest temperature condition) and, after cooling the leading edge portion 18, flows toward the downstream side. Therefore, the leading edge portion 18 can be satisfactorily cooled. Since the flow sectional area of the downstream side portion of the first cooling air passage 28 (i.e., final passage portion 40) is gradually decreased, the velocity of the air flowing therethrough is not reduced, despite the fact that part of the air is ejected for film cooling. Therefore, the surrounding portion of the final passage portion 40 (i.e., the intermediate portion of the blade portion 14) can be satisfactorily cooled. Although the film cooling holes 42 communicate with the final passage portion 40 on the downstream side of the first cooling air passage 28, pressure loss of air flowing therethrough is low, and hence, the air can be smoothly ejected from holes the film calling 42. For the same reason, air flowing through the first cooling air passage 28 reliably reaches the outlet port 38, and it can be delivered therefrom.

Low-temperature air introduced into the second cooling air passage 30 flows through the first passage portion 50 to cool the intermediate portion of the blade portion 14, and thereafter, the air flows through communicating passage portion 52 and final passage portion 56 to cool the trailing edge portion. In this manner, since the intermediate portion of the blade portion 14 can be cooled by air flowing through the first and second cooling air passage 28 and 30, the intermediate portion of the blade portion 14 can be cooled sufficiently. Since the intermediate portion of the blade portion 14 is also cooled by air flowing through the first cooling air passage 28, air flowing through the second cooling air passage 30 can be used mainly for cooling the trailing edge portion. Furthermore, since the air pressure is not reduced at the final passage portion 56, air can be smoothly discharged from the film cooling holes 58 and the outlet port 54. The trailing edge 20 can be sufficiently cooled by a cooling structure constituted by the slit 60, the pins 64, and the air holes 62.

As described above, the blade of this embodiment can sufficiently cool the blade main body 10 without exclusively adopting the film cooling method, the cooling means 26 and can protect the material constituting the blade from high temperatures over 1,300° C. No cooling holes for film cooling are formed in the leading and trailing edges of the blade portion 14, which can be easily affected by attachment of coal ash and corrosion due to the coal ash, and cooling holes are formed only in the intermediate portion of the blade portion 14, which is relatively less subjected to these adverse effects. For this reason, even when dirty fuel is used, the film cooling holes will not clog. Therefore, the blade of this embodiment can be applied to gas turbines using coal gasification fuel.

Figure 4:
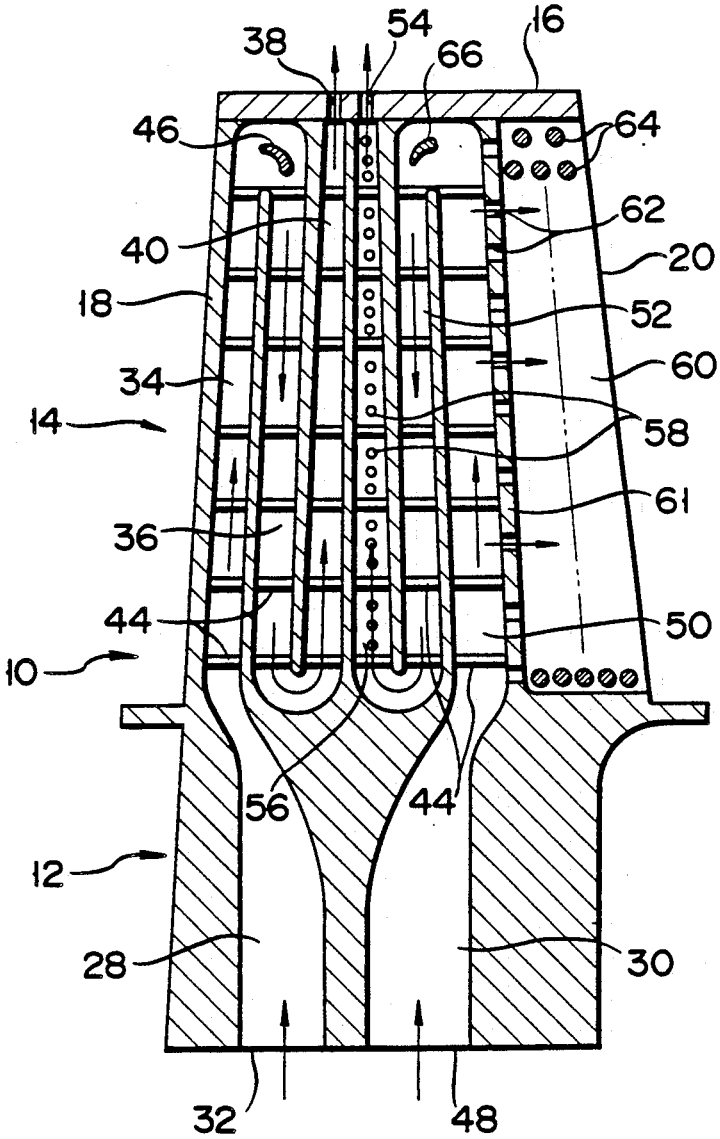
FIG. 4 is a longitudinal sectional view showing a gas turbine blade according to a second embodiment of the present invention.

FIG. 4 shows a blade according to a second embodiment of the present invention. In this embodiment, the arrangement of the second cooling air passage 30 is different from that in the first embodiment, and other arrangements are the same as those in the first embodiment. The same reference numerals in this embodiment denote the same parts as in the first embodiment, and a description thereof will be omitted.

As shown in FIG. 4, the first passage portion 50 of second cooling air passage 30 extends from the dovetail portion 12 close to the extended tip 16 of the blade portion 14 along the slit 60 formed in the trailing edge 20. The first passage portion 50 communicates with the slit 60 through the air holes 62 formed in the partition wall 61. The final passage portion 56 is located at the intermediate portion of the blade portion 14, and it extends from the dovetail portion 12 to the outlet port 54, which is open to the extended tip 16 of the blade portion 14. The final passage portion 56 is formed so that its flow sectional area is gradually decreased toward the outlet port 54, and it communicates with the film cooling holes 58, which are open to the pressure side surface 24. A corner vane 66 is arranged in a returning portion between the first passage portion 50 and the communicating passage portion 52.

According to the blade having the above arrangement, low-temperature air introduced from the cooling air inlet port 48 into the second cooling air passage 30 flows through the first passage portion 50 to cool the surrounding portion, and it is partially ejected from the air holes 62 into the slit 60. The remaining air flows through the communicating passage passage portion 52 to cool the surrounding portion, and thereafter, the air enters the final passage portion 56. The air is partially ejected from the film cooling holes 58 while the remaining air is delivered from the outlet port 54.

With the blade having the above arrangement, the same effect as in the first embodiment can be obtained.

Figure 6:
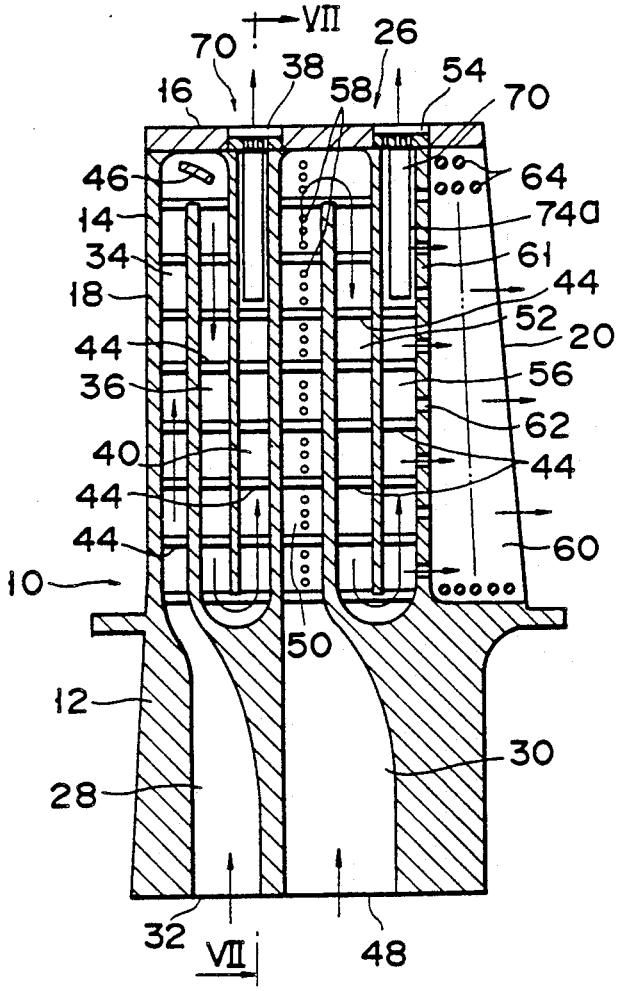
Figure 7:
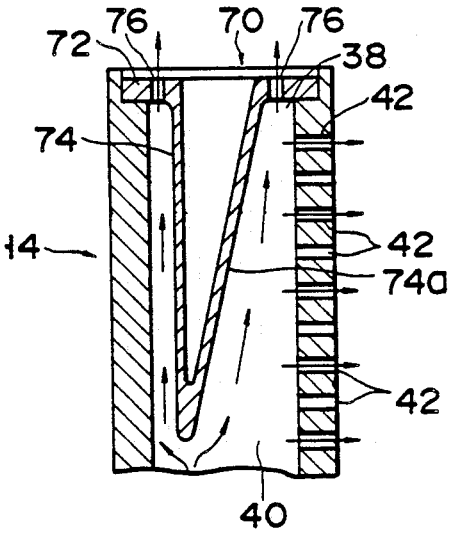
Figure 8:
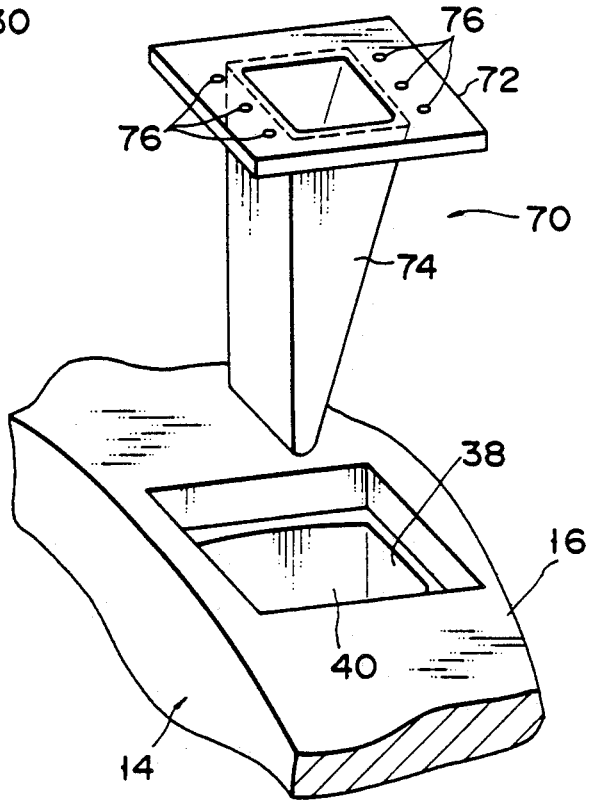

FIGS. 6 to 8 show a blade according to a third embodiment of the present invention. In this embodiment, the arrangement of final passage portion 40 and 56 of first and second cooling air passages 28 and 30 are different from those in first embodiment, and other arrangements are the same as those in the first embodiment. In this embodiment, the same parts as those in the first embodiment will be denoted by the same numerals, and a description thereof will be omitted.

As is shown in FIG. 6, final passage portion 40 of first cooling air passage 28 is formed so that its flow sectional area is uniform from dovetail portion 12 to outlet port 38 open to extended tip 16. End cap 70 is fitted into outlet port 38. As is shown in FIGS. 6 to 8, end cap 70 has rectangular substrate 40 and hollow protruding portion 74 shaped in the quadrangular pyramid and projecting from substrate 40. Protruding portion 74 has a longitudinal section of a right triangle. Outlet holes 76 are bored in substrate 72, surrounding protruding portion 74.

Substrate 40 of end cap 70 having above structure is soldered or welded to extended tip 16 to close outlet ports 38, and protruding portion 74 is inserted into final passage portion 40 through outlet port 38. Outlet holes 76 communicate with final passage portion 40. Protruding portion 74 extends for about ⅓ length of final passage portion 40, from outlet port 38 toward dovetail portion 12. Protruding portion 74 is oriented so that its slanting surface **74*a* faces film cooling holes 42 which are formed in blade portion 14**.

As in first cooling air passage 28, second final passage portion 56 of second cooling air passage 30 has a flow sectional area which is uniform from dovetail portion 12 to outlet port 54 open to extended tip 16. End cap 70 with the same construction as that of the above mentioned end cap is fitted into outlet port 54.

According to the third embodiment described above, the flow sectional area in final passage portion 40 of first cooling air passage 28 gradually decreases from about the middle portion of final passage portion 40 toward outlet port 38, due to protruding portion 74 of end cap 70 which is inserted into the final passage portion from the outlet port. Therefore, when low-temperature air introduced into final passage portion 40 flows around protruding portion 74, its velocity is not reduced, while part of the air is ejected outside through film cooling holes 42. Accordingly, the low-temperature air is smoothly discharged through film cooling holes 42, and readily reaches extended tip 16 of blade portion 14, and is also discharged from outlet holes 76.

As in final passage portion 40, the flow sectional area in final passage portion 56 of second cooling air passage 30 gradually decreases from about the middle of the final passage portion toward outlet port 54, due to protruding portion 74 of end cap 70. Therefore, low-temperature air introduced into final passage portion 56 is smoothly discharged through orifice holes 62, and securely reaches extended tip 16 of blade portion 14, and is also discharged from outlet holes 76.

Thus, the third embodiment achieves the same advantage as the first embodiment. Further, in this embodiment, the advantages can be obtained merely by attaching end caps 70 to the blade portion of the known type, without remolding the arrangement of the final passage portion, or forming the final passage portion into a specific shape. Since protruding portion 74 of end cap 70 is hollow, the end cap is relatively light, And, since the centrifugal force at end cap 70, caused by rotation of the blade, is small, the end cap can be prevented from getting off the blade.

Figure 9:
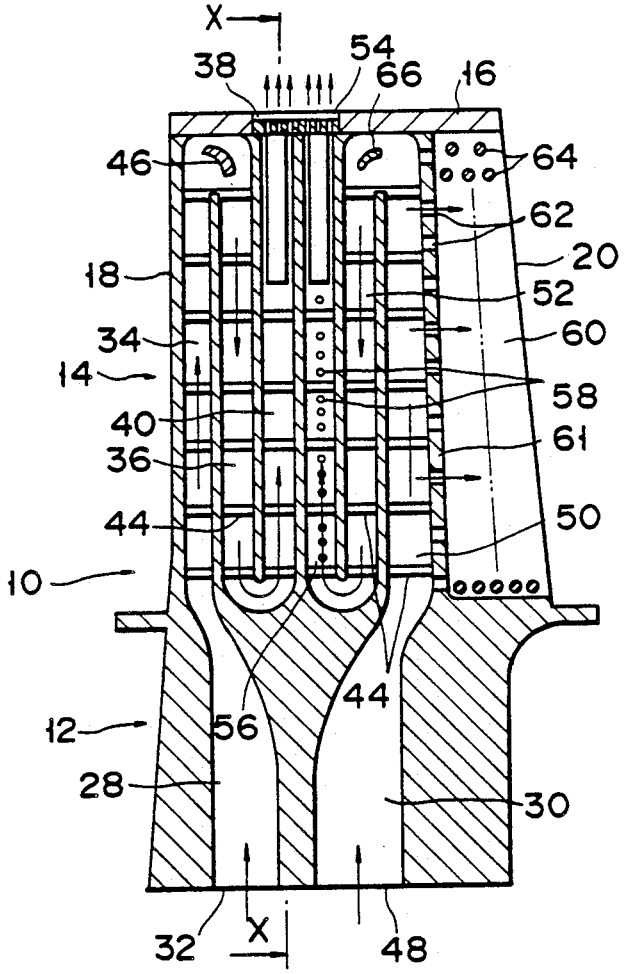
Figure 10:
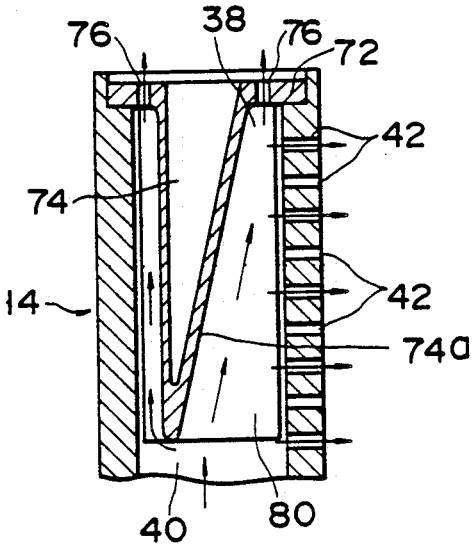
Figure 11:
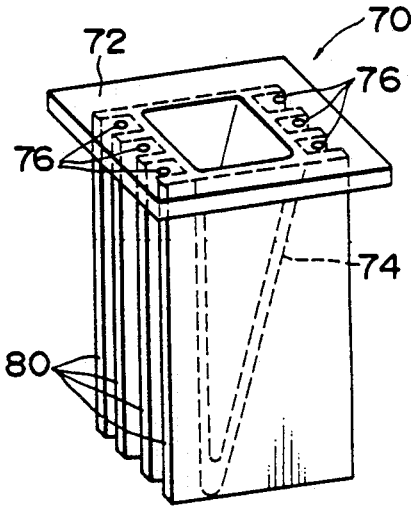

FIGS. 9 to 11 show a fourth embodiment of the present invention. In this embodiment, each end cap 70 is provided with radiator plates 80 parallel to each other, which are formed integral with substrate 72 and protruding portion 74. Plates 80 divide that part of the final passage portion which is located around protruding portion 74 into several passages each of which communicates with outlet hole 76. Slanting surfaces **74*a* of protruding portions 74 face film cooling holes 42 and 58, respectively. In the fourth embodiment, as well as the second embodiment, second cooling air passage 30 extends from trailing edge 20 side of blade portion 14** toward the middle portion thereof. The other parts are the same as in the third embodiment, will be denoted by the same numerals, and will not be described.

The fourth embodiment accomplishes the same advantages as the third embodiment. Further, since each end cap 70 has a plurality of radiator plates 80, the convection-cooling effect increases in blade portion 40, and thus the blade can be effectively cooled.

In the third and fourth embodiments, protruding portion 74 of end cap 70 need to be tapered from the outlet port of the final passage portion toward dovetail portion 12. However, the shape of protruding portion 74 is not limited only to a quadrangular pyramid, but may be other one such as circular cone or a trigonal pyramid.

The present invention is not limited to the above embodiments, and various changes and modifications may be made within the spirit and scope of the invention.

Figure 5:
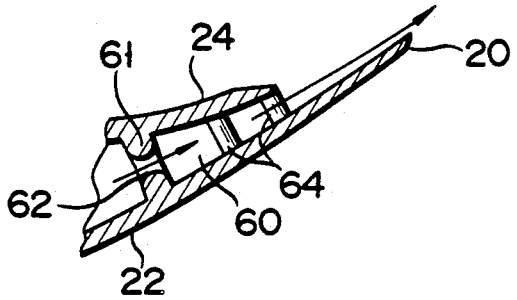
FIG. 5 is a sectional view showing part of a blade according to a modification.

For example, in the first cooling air passage, the number of the communicating passage portions is not limited to one, and that number can be increased as needed. As shown in FIG. 5, a pressure-side wall portion constituting the trailing edge portion can be partially notched, so as to prevent occurrence of a high-temperature portion at the trailing edge.

Furthermore, the present invention can be applied to both the rotor blade and the nozzle vane of the gas turbine. The present invention is not limited to gas turbines using dirty fuel, but can also be applied to gas turbines using clean fuel.

What is claimed is:

1. A blade of a gas turbine, said blade comprising:

a main body including a dovetail portion and a blade portion extending from said dovetail portion, said blade portion having an extended tip, leading and trailing edges which extend substantially along the extending direction of said blade portion, and a suction side surface and a pressure side surface which are located between said leading and trailing edges and face each other; and (b) cooling means for introducing cooling air inside said main body to cool said main body, said cooling means including a first cooling air passage formed in said main body, said first cooling air passage including:

(i) a cooling air inlet port open to said dovetail portion;

(ii) an outlet port in said extended tip of said blade portion;

(iii) a first passage portion extending from said cooling air inlet port close to said extended tip along said leading edge;

(iv) a final passage portion extending from said dovetail portion to said outlet port; and (v) a plurality of film cooling holes which extend from said suction side surface of said blade portion to said final passage portion of said first cooling air passage, (vi) said cooling means having decreasing means fitted to said outlet port, for gradually decreasing a flow sectional area of said final passage portion from said dovetail portion toward said outlet port so that the speed of the cooling air flowing through said final passage portion does not fall despite the fact that air flows out through said plurality of film cooling holes.

2. A blade according to claim 1, wherein:

(a) said final passage portion is located at substantially a midpoint between said leading and trailing edges and (b) said plurality of film cooling holes are aligned along the extending direction of said final passage portion.

3. A blade according to claim 1, wherein said first cooling air passage has at least one communicating passage portion which extends along the extending direction of said blade portion and connects said first passage portion and said final passage portion.

4. A blade according to claim 1, wherein said cooling means further comprises a second cooling air passage formed in said main body, said second cooling air passage including:

(a) a cooling air inlet port open to said dovetail portion;

(b) an outlet port in said extended tip of said blade portion;

(c) a first passage portion extending from said cooling air inlet port close to said extended tip;

(d) a final passage portion extending from said dovetail portion to said outlet port; and (e) a plurality of air holes which extend from said final passage portion of said second cooling air passage to the outside of said main body at said trailing edge of said blade portion, (f) said cooling means having second decreasing means fitted to said outlet port of said second cooling air passage, for gradually decreasing a flow sectional area of said final passage portion of said second cooling air passage from said dovetail portion toward said outlet port so that the speed of the cooling air flowing through said final passage portion does not fall despite the fact that air flows out through said plurality of air holes.

5. A blade according to claim 4, wherein:

(a) said first passage portion of said second cooling air passage is located at substantially a midpoint between said leading and trailing edges;

(b) said final passage portion of said second cooling air passage extends adjacent to said trailing edge; and (c) said second cooling air passage has a plurality of film cooling holes which extend from said pressure side surface of said blade portion to said first passage portion of said second cooling air passage.

6. A blade according to claim 5, wherein:

(a) said blade portion includes a slit formed along said trailing edge;

(b) a large number of pins are arranged in said slit and extend in a direction perpendicular to said pressure and suction side surfaces; and (c) said air holes connect said final passage portion of said second cooling air passage and said slit.

7. A blade according to claim 4, wherein:

(a) said first passage portion of said second cooling air passage extends adjacent to said trailing edge;

(b) said air passage is located at substantially a midpoint between said leading and trailing edges; and (c) said air holes are a plurality of film cooling holes which extend from said pressure side surface of said blade portion to said final passage portion of said second cooling air passage.

8. A blade according to claim 7, wherein:

(a) said blade portion includes a slit formed along said trailing edge;

(b) a large number of pins are arranged in said slit and extend in a direction perpendicular to said pressure and suction side surface; and (c) said second cooling air passage has a plurality of orifice holes which connect said first passage portion of said second cooling air passage and said slit.

9. A blade according to claim 1, wherein said decreasing means includes a substrate and a tapering protruding portion extending from said substrate, said substrate being fixed to the end tip of said blade portion so as to close said outlet port, and having outlet holes communicating with said final passage portion, and said protruding portion being inserted in said final passage portion from said outlet port.

10. A blade according to claim 9, wherein said protruding portion is hollow.

11. A blade according to claim 9, wherein said protruding has a slanting surface slanting to the direction in which said final passage portion extends, said slanting surface facing said film cooling holes.

12. A blade according to claim 9, wherein said decreasing means includes a plurality of radiator plates fixed to said protruding portion, and dividing that part of said final passage portion, which is located around the protruding portion, into a plurality of passages communicating with said outlet holes, respectively.

13. A blade according to claim 4, wherein said second decreasing means includes a substrate and a tapering protruding portion extending from said blade substrate, said substrate being fixed to the end tip of said blade portion so as to close said outlet port of said second cooling air passage, and said protruding portion being inserted in said final passage portion from said outlet port.

14. A blade according to claim 12, wherein said protruding portion is hollow.

15. A blade according to claim 12, wherein said protruding portion has a slanting surface to the direction in which said final passage portion of said second cooling air passage extends, said slanting surface facing said air holes.

16. A blade according to claim 12, wherein said second decreasing means includes a plurality of radiator plates fixed to said protruding portion, and dividing that part of said final passage portion of said second cooling air passage, which is located around the protruding portion, into a plurality of passages communicating with said outlet holes, respectively.

* * * * *